US006076599A

United States Patent [19]

McKinzie

[11] Patent Number: 6,076,599

[45] Date of Patent: Jun. 20, 2000

[54] METHODS USING DUAL ACTING PUMPS OR DUAL PUMPS TO ACHIEVE CORE ANNULAR FLOW IN PRODUCING WELLS

[75] Inventor: Howard W. McKinzie, Sugarland, Tex.

[73] Assignee: Texaco Inc., White Plains, N.Y.

[21] Appl. No.: 08/908,889

[22] Filed: Aug. 8, 1997

[51] Int. Cl.[7] ..... E21B 43/00

[52] U.S. Cl. ..... 166/105

[58] Field of Search ..... 166/105, 281, 166/267; 137/13

[56] References Cited

U.S. PATENT DOCUMENTS 3,827,495 8/1974 Reed ..... 166/281
3,977,469 8/1976 Broussard et al. ..... 160/267 X
4,745,937 5/1988 Zagustin et al. ..... 137/13
4,753,261 6/1988 Zagustin et al. ..... 137/13
5,159,977 11/1992 Zabaras ..... 166/105

*Primary Examiner*—Frank Tsay
*Attorney, Agent, or Firm*—Harold J. Delhommer; William J. Beard

[57] ABSTRACT

A system is disclosed for the more efficient production of heavy or viscous crudes in oil wells. A cased wellbore into a production zone is provided with a single production tubing string from the production zone to the surface. A dual pumping system or dual action pumping system is used to separately flow produced heavy crude and produced geometrical manner to induce core annular flow of the heavy crude and a portion of produced water to the earth's surface.

2 Claims, 1 Drawing Sheet

METHODS USING DUAL ACTING PUMPS OR DUAL PUMPS TO ACHIEVE CORE ANNULAR FLOW IN PRODUCING WELLS

FIELD OF THE INVENTION

This invention pertains to production techniques in oil wells, and more particularly, to production techniques for increasing the efficiency of oil production in heavy crude producing wells or very viscous crude producing wells.

BACKGROUND OF THE INVENTION

In recent times several techniques for using dual pumps or dual acting pumping systems in well completion and production techniques have been disclosed and used. In these techniques, the well borehole annulus (cased) in a production zone producing oil and water has been used to gravity separate the produced oil from the produced water. Dual acting pumps or dual pumps are then used to pump the produced oil to the surface via production tubing and to reinject the produced water into a disposal zone, either above or below, the production zone. The heavier produced water settles to the bottom of the casing/tubing annulus and a pump inlet near the bottom of the production zone picks up primarily produced water, if placed there. Similarly, a second pump inlet placed a distance uphole, around or above the production perforation, picks up primarily oil, if placed there. If the water is re-injected below the production zone, usually a packer is set in the casing below the production zone and the water simply pumped below this packer to re-enter the disposal zone through disposal perforations located below the packer. If the disposal zone is located above the production zone in the well, then the production zone must be isolated, interior to the casing, by a packer placed between the disposal zone and the production zone in the casing. This packer must be penetrated by both the production tubing string and a tubing string carrying the produced water to the disposal zone perforations. The use of such dual tubing strings becomes difficult in small diameter well casing such as 5 inch ID (inside diameter) casing, since standard production tubing has an (outer diameter) OD of # inches. It would be desirable therefore to avoid the use of dual tubing strings, if possible.

If the produced crude oil in a well has a high viscosity (such as those heavy crudes in many parts of the U.S. and the world), say up to 110,000 (centiPoise) cP, then friction losses in pumping such viscous crudes through tubing or pipe can become very significant. Such friction losses (of pumping energy) are due to the shearing stresses between the pipe or tubing wall and the fluid being transported. This can cause significant pressure gradients along the pipe or tubing. In extremely viscous crude production such pressure gradients cause large energy losses in pumping systems, both within the well and in surface pipelines. Typically, attempts to lower the crude oil viscosity by the use of diluents or through heating have been used. It has also been proposed to form oil/water emulsions by using re-injected produced water or such water in an oil-in-water emulsion stabilized by chemical agents. All such techniques have the disadvantage of being expensive and energy consumptive. It would therefore be desirable to provide economical, simple techniques for moving heavy or viscous crudes in pipe or tubing flow in a well without resorting to dual tubing strings or to heat or chemical injection to lower viscosity of the crude.

It has recently been proposed to use the flow regime, or mode known as core annular flow to improve the portability of heavy crude in surface pipelines. In core annular flow a less viscous immersible fluid, such as water, is introduced into the crude flow in a particular geometrical manner to form a sheath or layer of flow next to the tubing or pipe wall with the heavy crude moving interiorly to the annular flow of the less viscous fluid. The core annular flow mode greatly reduces the pressure required to move viscous crude in a pipe or tubing string.

BRIEF DESCRIPTION OF THE INVENTION

In the present invention the crude oil and water produced from a production zone are allowed to separate by gravity in a segregated portion of the casing/production tubing annulus in a well borehole. A pump inlet located low in the production zone picks up primarily water which (at least a portion thereof) is then injected into the production tubing in a geometrical manner to form a circumferential sheath of water around the interior circumference of the production tubing going to the surface. A second pump inlet located higher in the production zone picks up primarily oil and the pump system injects it into the center of interior portion of the production tubing going to the surface. This creates a core annular flow regime in the production tubing. Once the core annular flow is established, the resistance to fluid flow in the production tubing is reduced to a fraction of that of an oil-continuous phase. The remainder of the produced water not used for the core annular flow regime may then be disposed of the same as previously mentioned, such as by re-injection in a disposal zone. This technique is particularly effective with crude oils having a viscosity of greater than about 1000 cP.

The invention will be best understood by reference to the following detailed description thereof when taken in conjunction with the accompanying drawings. While the invention will be described in detail with respect to a preferred embodiment, it will be understood by those of skill in the art, that such descriptions are intended as illustrative only and not as limitative of the scope and concepts of the invention.

DETAILED DESCRIPTION OF THE PREFERRED EMBODIMENT

Figure 1:
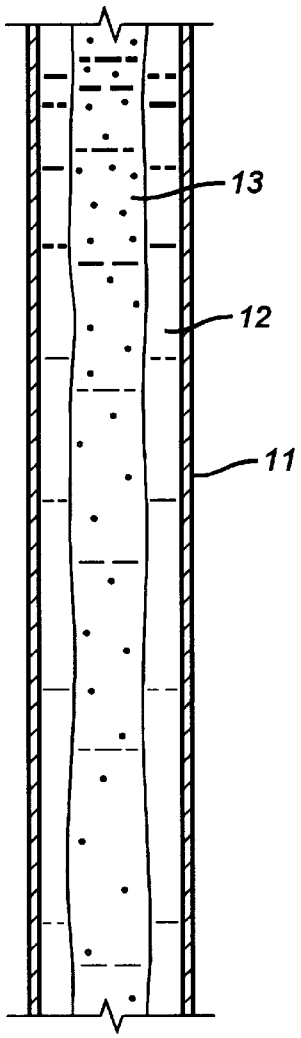
FIG. 1 is a schematic cross sectional view of a tubing string in which a core annular flow regime is in place.

In the present invention fluid flow of produced high viscosity crude from a production zone in a well to the surface is enhanced and rendered more efficient by the practice of inducing core annular flow in the tubing string from the production zone to the surface or beyond. Referring initially to FIG. 1 a tubing string is shown schematically in cross section. Steal tubing 11 extends from the surface to the production zone in a producing well (not shown in FIG. 1). Flow of fluid in tubing 11 is upward as indicated by the direction of the flow arrow. A thin annular layer of water 12 flows in touching communication with the interior wall of the tubing 11. A crude oil core of flow 13 flows entirely within the annular water flow sheath 12 and does not contact the wall of tubing 11. This flow mode or flow regime is known as core annular flow. Of all the flow patterns or modes which may be generated by water injection in a tubing or pipeline, core annular flow has been found to give the greatest resistive pressure gradient reduction. For crude oils of up to 110,000 cP, stable operation has been found to be feasible with as little as 1% water introduction into the tubing string or pipeline.

Figure 2:
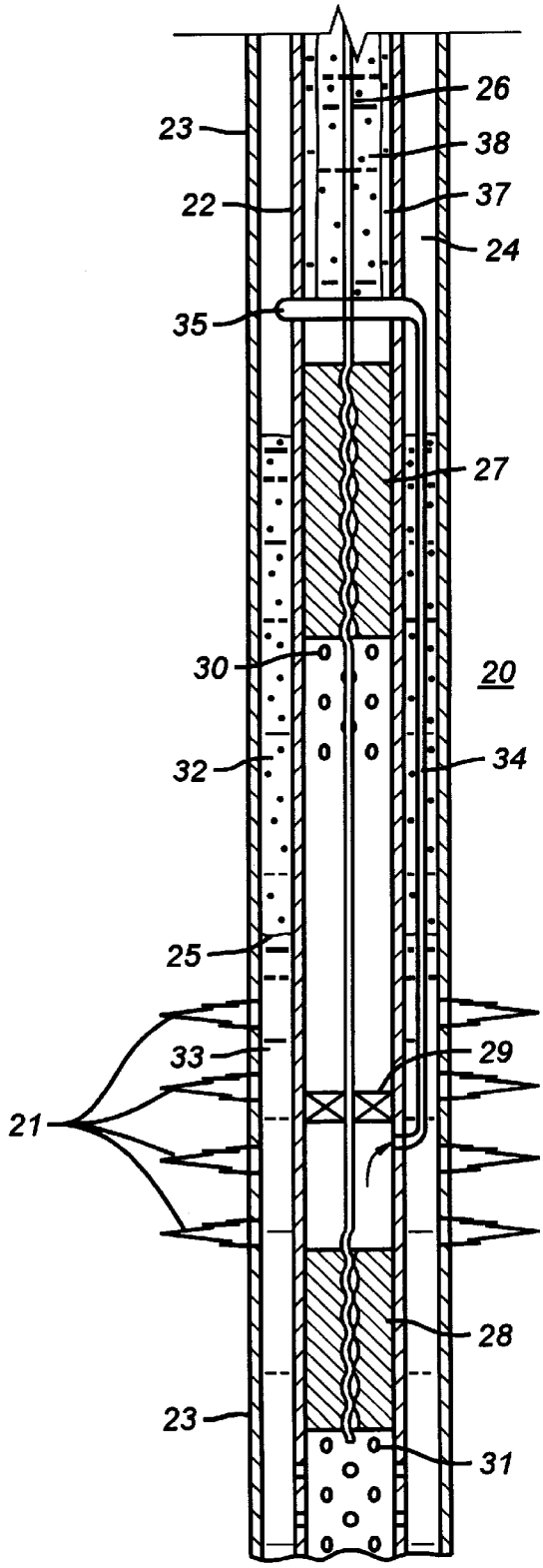
FIG. 2 is a schematic cross sectional view of a well completion and production system employing the core annular flow more concepts of the invention and using a pair of surface rod driven progressing cavity pumps to produce this flow regime in the production tubing.

Referring now to FIG. 2 a completed well in production is shown schematically in cross section. Production perforations 21 produce a combination of oil and water from a production zone 20. Produced fluid enters the casing 23/tubing 22 annulus 24 via perforations 21. The produced fluid is allowed to separate in the casing/tubing annulus 24 under the influence of gravity and thus forms an oil/water interface 25 inside the casing 23. In the embodiment shown in FIG. 2, dual rod driven progressing cavity pumps (PC pumps) are shown suspended in the production tubing string 22. A rod string 26 extends to the surface where it is rotated by a surface electric motor as desired. Rod string 26 extends through an upper PC pump 27 and terminates in a lower PC pump 28 which is separated from upper pump 27 by a rod seal 29. The fluid inlet 30 for the upper PC pump 27 is located above the oil/water interface 25 and picks up primarily produced separated crude oil phase 32 in the casing. Similarly the fluid inlet 31 for the lower PC pump 28 is located in the portion of the casing 23 below the oil/water interface 25 and picks up primarily separated water phase 33 from the produced fluid. An auxiliary output of lower PC pumps 28 is via a relatively small diameter tubing showing 34 which connects pump 28 to a tubular injection ring 35 in the tubing 22 above the upper PC pump 27. If desired, the remainder of the produced separated water is pumped via the main outlet (not shown) of lower PC pump 28 into a disposal zone (not shown) located above or below the illustrated apparatus.

The portion of the water production pumped upward by the lower PC pump 28 in tubing 34 is injected in an upward direction completely circumferentially about the interior wall of production tubing string 22. This forms a water sheath or annulus 37 analogous to that of 12 of FIG. 1. Similarly upper PC pump 27 picks up primarily oil 38 from above the oil/water interface 25 injects it interiorly into tubing 22 where it forms an oil core 38 analogous to that of 13 of FIG. 1. The very efficient core annular flow regime thus induced in production tubing string 22 conducts the heavy crude and a fraction of the produced water to the surface in a very efficient manner.

It will be understood by those of skill in the art that a single dual action pump could be used, if desired, or that two pumps of other types such as submersible electrically powered turbine pumps, or centrifugal pumps, or rod driven mechnical pumps could be used to create the core annular flow in production tubing 22, if desired. Similarly the present disclosure may make other alternative arrangements apparent to those of skill in the art. It is the aim of the appended claims to cover all such changes and modifications that fall within the true spirit and scope of the invention.

What is claimed is:

1. A system for producing heavy or viscous crude efficiently from a production zone in an oil well to the surface of the earth, comprising:

a well casing extending from the earth's surface through a production zone in a well and having production perforations in said production zone to allow production well fluids to enter said casing;

a production tubing string extending from the surface of the earth coaxially with said casing to said production zone and forming a tubing/casing annulus in which said production well fluids are allowed to separate by gravity into oil and water and an oil/water interface is formed in said annulus;

dual PC pumping means having an oil inlet and a water inlet placed in said tubing/casing annulus to inlet primarily oil and primarily water into said dual PC pumping means respectively from above and below said oil/water interface in said tubing/casing annulus; and means for combining at least a portion of said respective outputs of said dual PC pumping means in said production tubing string above said dual PC pumping means outputs to form a core annular flow regeime of dual fluids from said production zone to the earth's surface, said means for combining including an annular tubular injection ring supplied with primarily water from said dual PC pumping means water inlet. said injection ring acting to form a water sheath contacting the inside wall of said production tubing string.

2. The system of claim 1 wherein said dual PCP pumps are rotary rod driven PC pumps.

* * * * *